US005831197A

United States Patent [19]

Bill et al.

[11] Patent Number: 5,831,197

[45] Date of Patent: Nov. 3, 1998

[54] PRIMER STRIP LOADING TOOL

[75] Inventors: Eugene F. Bill, Oroville; Fred B. Blodgett, Chico; Jerry D. Brand, Oroville; Steven J. Koch, Oroville; Lester V. Rodriques, Oroville; Alan D. Schufeldt, Oroville; Steven R. Shields, Oroville; Ronald L. Smith, Oroville, all of Calif.

[73] Assignee: Blount, Inc., Montgomery, Ala.

[21] Appl. No.: 841,862

[22] Filed: May 5, 1997

[51] Int. Cl.[6] ..... F42B 33/02

[52] U.S. Cl. ..... 86/23; 86/45; 86/28

[58] Field of Search ..... 86/23, 24, 25, 86/26, 27, 45, 46, 47, 48, 28, 1.1, 10, 32, 33, 36, 37, 38

[56] References Cited

U.S. PATENT DOCUMENTS

| | | | |
|---|---|---|---|
| 2,480,834 | 9/1949 | Bureau | 86/48 |
| 2,542,988 | 2/1951 | Bureau | 86/48 |
| 2,615,363 | 10/1952 | Martyn | 86/23 |
| 2,619,869 | 12/1952 | Stewart | 86/1.1 |
| 2,818,964 | 1/1958 | Picard et al. | 86/25 |
| 2,953,058 | 9/1960 | Ristine, Jr. | 86/23 |
| 3,152,508 | 10/1964 | Fratila | 86/36 |
| 3,224,318 | 12/1965 | Bachhuber . | |
| 3,320,848 | 5/1967 | Ponsness | 86/23 |
| 3,349,663 | 10/1967 | Slee . | |
| 3,973,465 | 8/1976 | Bachhuber et al. | 86/45 |
| 4,223,588 | 9/1980 | Simpson | 86/45 |
| 4,261,680 | 4/1981 | Carnley et al. | 86/45 |
| 4,331,063 | 5/1982 | Schaenzer | 86/36 |
| 4,425,833 | 1/1984 | Purdie | 86/44 |
| 4,429,610 | 2/1984 | Mantel . | |
| 4,522,102 | 6/1985 | Pickens | 86/27 |
| 4,651,619 | 3/1987 | Voecks | 86/44 |
| 4,817,491 | 4/1989 | Fenton | 86/45 |
| 4,841,831 | 6/1989 | Bender et al. . | |
| 5,198,606 | 3/1993 | Storstad et al. . | |
| 5,435,223 | 7/1995 | Blodgett et al. . | |
| 5,693,905 | 12/1997 | Blodgett et al. | 86/32 |

*Primary Examiner*—Charles T. Jordan
*Assistant Examiner*—Theresa M. Wesson
*Attorney, Agent, or Firm*—Klarquist Sparkman Campbell Leigh & Whinston, LLP

[57] ABSTRACT

A device and method for loading primers into primer receptacles of a rectilinear primer holder strip. The device includes an elongated track for longitudinally guiding the primer strip through a primer loading station. The primer strip includes a series of longitudinally aligned receptacles, each of which is designed to hold a primer in an interference fit that prevents dislodgement of the primer from the strip. Each primer strip also has a plurality of laterally extending castellations including teeth and depressions that slide on a ledge within the track. The track of the loading device is of substantially the same width as the strip, such that the strip slides through the track. A primer delivery slot in the device delivers a primer into the track, and a pressure application device is positioned to press the primer into a target primer receptacle. In one embodiment, the pressure application member is an inclined surface above the track that pushes the primer into the receptacle as the strip is advanced toward the inclined surface to eliminate clearance space above the strip. In another embodiment, the pressure member is a push pin that is biased to a retracted position, but which can be advanced to push the primer into a target receptacle in the strip. In either embodiment, advancement of the strip along the track sequentially loads primers into each of the receptacles in the strip. The device may be hand held and manually operated.

32 Claims, 8 Drawing Sheets

PRIMER STRIP LOADING TOOL

FIELD OF THE INVENTION

This invention relates generally to ammunition reloading systems, and more specifically to a system for safely and conveniently loading primers into a component holder for subsequent transfer to a cartridge casing.

BACKGROUND OF THE INVENTION

Ammunition for a firearm typically includes a bullet seated within the neck of a cartridge case. The case is a hollow cylinder with an open end sized to tightly hold the bullet, and a closed head end of the case having a socket that receives a primer containing a small amount of combustible material. When the firearm is discharged, a firing pin or hammer strikes the exposed portion of the primer to ignite the primer in the socket.

The combustible material in the primer socket undergoes a fast, controlled burn which in turn ignites gunpowder inside the cartridge case via a flash hole, to propel the bullet toward a target. Although the bullet may be deformed by striking its target, the cartridge case generally remains intact after firing, with the spent primer wedged in the end of the case. The case often may be reloaded and reused.

Many firearm enthusiasts reload their own ammunition to reduce costs, control the quality of the reloading, and to have the ability to customize the ammunition. The ability to reload the cartridge cases is particularly important to gun enthusiasts and military or law enforcement personnel, who may fire numerous rounds during practice sessions. Reloading involves several steps, including removing the spent primer, reforming the case to a desired shape and size, and inserting a new primer into the empty primer socket. Devices have been developed in the past to perform all these functions, either sequentially or simultaneously on multiple casings.

U.S. Pat. No. 5,198,606, for example, discloses an apparatus that removes the spent primer, and pushes a replacement primer out of a disk shaped holder to transfer the primer to the primer socket. The primers are positioned in chambers that are aligned peripherally around an edge of the disk, and the disk is incrementally rotated to sequentially align target receptacles with a pusher pin that transfers the primer from the target receptacle to the primer socket.

The disk shaped primer holder of the '606 patent provides a rigid structure that retains the primers in an interference fit to minimize handling of the primers, and improve safety of the priming operation. This disk must be removed and replaced when empty, however, which can impair the efficiency and speed of the priming operation. It is also difficult to determine from the position of the disk how many of the primers have been unloaded because the disk is symmetric about its center of rotation. The disk also inherently requires unused space toward the center of the disk, that is unavailable for storing primers.

Component holders of the type shown in the '606 patent generally are preloaded at a manufacturing facility. Yet gun enthusiasts may sometimes want to reload the holder with components of their own choosing. The disk shaped component holder, however, requires special manufacturing equipment to reload it. Individual insertion of components into the holder by manual manipulation of the components is impractical.

It is an object of this invention to provide a device and method for conveniently and efficiently loading primers into a component holder.

Yet another object is to provide such a device and method that can be adapted for use with a component holder of a convenient size and shape.

SUMMARY OF THE INVENTION

A strip shaped component holder is disclosed in co-pending U.S. patent application Ser. Nos. 08/599,962 pending and 08/710,317, now U.S. Pat. No. 5,693,905. These strips solve many of the problems of the disk-shaped holder of the prior art by eliminating wasted space, and allowing interconnection of sequential strips. Application Ser. No. 08/599,962 pending also describes a device for loading primers into a primer holder strip from a large tray that orients many primers and simultaneously delivers them into a target position on top of the strip. A bar with multiple projections is then pushed toward the strip to simultaneously force multiple primers into respective receptacles in the strip.

The elongated, primer holder strip contains a plurality of longitudinally aligned, generally cylindrical primer receptacles that each holds a primer in an interference fit. The strip is provided with a series of equally spaced teeth or castellations extending laterally from both longitudinal edges of the strip. The teeth have a fixed position relative to the receptacles, so that the position of the teeth can be used to position the receptacles in a desired location.

The invention disclosed in the present specification is a modified loading device, that is more suitable for hand-held operation and sequential loading of individual primers into receptacles in the strip as the strip is longitudinally advanced through the loading device. The device includes an elongated track through the device, and the track is of substantially a same width as the strip, such that the strip slides in close tolerance through the track. A primer delivery slot in the device is positioned to deliver a single primer at a time into the track. A pressure application member positioned above the track then presses the primer into the primer receptacle.

In a more specific embodiment, the device includes a delivery tray that is inclined relative to the track, and a plurality of primers may be placed in the tray. The tray is positioned transverse to the track, and the tray funnels primers in the tray toward an outlet, where a sprocket wheel accepts a primer, then rotates to deliver the primer into a delivery slot. The delivery slot extends downwardly transverse to the track, and delivers the primer into the track on top of the strip. The pressure application member is an inclined surface above the track, which inclines downwardly in the direction of advancement of the strip through the track. As the strip advances beneath the inclined surface, the primer delivered into the track upstream of the pressure application member is progressively pressed into a target receptacle in the strip.

In another embodiment of the invention, the tray is replaced by a rigid delivery member, such as a longitudinally extending ramp that is inclined at a fixed angle to the track. A delivery slot extends through the inclined ramp, in a common vertical plane with the track. The delivery slot merges with the track at a position upstream of the pressure application member, so that primer is delivered through the slot on to the strip in registry with a receptacle. Progressive movement of the strip through the track drags primers on top of the strip in the direction of the pressure application member, so that the primers are sequentially progressively pressed into respective receptacles on the strip by the inclined bottom surface of the pressure application member.

In yet another embodiment of the device, the track extends through a primer loading station. Primers are introduced into the loading station through a delivery slot that extends transverse to the track. The delivery slot intersects the track at a primer loading position, where a target receptacle in the strip is also positioned. A push pin reciprocates towards and away from the primer loading position, so that the primer fed into the loading station can be pushed into the target receptacle of the strip by advancement of the push pin when the target receptacle is aligned with the push pin and primer. The push pin is biased to a retracted position (by a spring or resilient grip member) to provide a clearance within the loading station for delivery of the primer. The bias of the spring can be overcome by pushing the pin or squeezing the grip member to advance the push pin toward the aligned primer and target receptacle, which inserts the primer into the receptacle.

The present invention also includes methods of loading primers into a primer holder strip having primer receptacles positioned longitudinally along the strip, and teeth extending transversely from longitudinal edges of the strip. The method includes providing a loading device having an elongated track extending through the device, wherein the track is of substantially the same width as the strip, and the track allows the strip to move in a straight path through the elongated track. A primer delivery slot in the device is positioned to deliver a primer into the track on the strip, and a pressure application member is positioned to press the primer into a primer receptacle. The strip is advanced through the track toward the pressure application member, where the primer on the strip is pushed into a receptacle by the pressure application member.

The device of the present invention is compact and capable of hand operation. It can be made of a size and shape that fits easily in the human hand, and can be operated by manual manipulation. It is a convenient and simple device that is suitable for use by the hobbyist who wants to reuse an empty primer loader strip from which primers have already been transferred to cartridge casings.

A better understanding of the invention can be had by reference to the following drawings and detailed description.

DETAILED DESCRIPTION OF A PREFERRED EMBODIMENT

Primer Holder Strips

Figure 1:
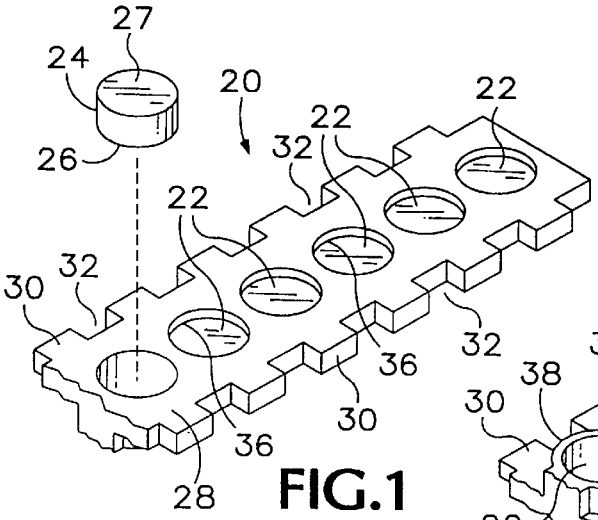
FIG. 1 is an enlarged, isolated, perspective, fragmentary top view of a primer strip that slides through the device, and into which primers are loaded.
Figure 2:
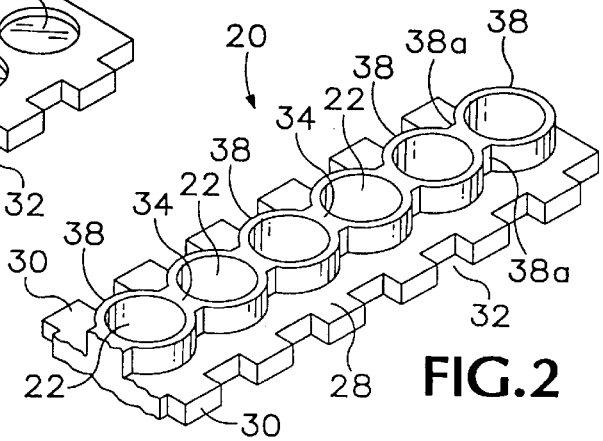
FIG. 2 is a bottom perspective view of the strip of FIG. 1.

The device of the present invention is designed to load primers into a primer holder strip 20 (FIGS. 1–2) that is subsequently used to reload primers into spent cartridge casings. Strip 20 is a generally rectilinear member having a plurality of primer containing receptacles 22, each of which carries a conventional primer 24 having a frustoconical bottom (FIGS. 1 and 4) that tapers to a flat bottom face 26, and a flat top face 27. FIGS. 1–2 show a preferred embodiment of the strip 20, which is preferably a molded polymeric part, for example a resinous plastic material. A suitable material for the strip is polypropylene, but other thermoplastic polymeric materials may also be used. In the disclosed embodiment, the strip is long and narrow (for example, 12 cm long and 12 mm wide including the teeth), and shallow (about 4 to 5 mm deep).

Strip 20 includes a substantially planar portion 28 (FIGS. 1–2) that provides a basic frame having opposing longitudinal edges, from which project a series of longitudinally spaced lateral projections in the form of identical castellations or teeth 30 that extend in the plane of portion 28. An axis of symmetry runs along the longitudinal axis of the strip, such that each half of the strip (including the castellations) are the mirror image of the other half. The teeth 30 form a series of gaps or depressoins 32 that provide a means of indexing the strip 20 as the strip progresses along a track in the primer loading device or a cartridge case primer loading device.

Each receptacle 22 is a substantially tubular member (FIG. 2) formed by an orifice 36 in the strip, and a substantially tubular extension 38 depending from the planar portion. Laterally facing depressions 38*a* are formed between adjacent tubular extensions 38. The tubular portions of the receptacles form a bas relief lower face of the strip. Each receptacle 22 holds a corresponding primer 24 in a tight, interference fit such that the primer is not easily dislodged from the receptacle during transportation, or at any time before it is desired to load the primer into the cartridge case primer socket. The interior walls of each receptacle have flattened areas (not shown) to improve the interference fit between the primer 24 and receptacle 22.

Receptacles 22 are of substantially equal radius (for example, 2.5 mm), which is slightly less than the radius of the primer 24, and the receptacles are substantially equally spaced along the length of strip 20, with adjacent receptacles having a common tangential wall 34. The width of each tooth 30 is about one-half the distance between the centers of each tubular receptacle 22, and the width of each gap 32 is also about one-half the distance between the centers of each receptacle 22. The teeth are also provided in a fixed location with respect to each receptacle 22, such that the position of the tooth predictably locates its associated receptacle in a desired target location. There is very little wasted space in the strip, because the receptacles occupy the majority of the volume of the strip.

A hook 44 (FIGS. 3–4) extends longitudinally from one transverse edge of the strip 20 in the plane of the tubular extensions 38. Hook 44 includes opposing, complementary arms 46, 48 that form a portion of a tubular extension 50. In the disclosed embodiment, arms 46, 48 form over one-half of a tubular extension, without any overlying planar portion 28. The tubular extension of a receptacle at the end of a first strip can be placed within the arms 46, 48 of a second strip, such that the second strip will be dragged along behind the first strip in the same direction that the strip is advanced longitudinally along a track through device 60.

Coded strips 20 of varying size and color can be made to hold primers of different sizes. Color coding of the strips helps assure that primers of the appropriate size are loaded into a corresponding cartridge case having a primer socket of the appropriate size. Use of the strips also avoids the necessity of handling individual primers, and eliminates stacking the primers, which can lead to sympathetic explosion of multiple primers during shipping or priming if one of the primers is inadvertently ignited.

The elongated strips 20 also offer several advantages over rotary primer holders, such as the one shown in U.S. Pat. No. 5,198,606. The primer strips of the present invention have less wasted space than a rotary disk because much more of the strip can be used to hold primers; a rotary disk has wasted space at the center of the disk that increases in proportion to the circumference of the disk. The linear advancement of the primer strip of the present invention in a straight path also avoids the necessity of providing structures to convert linear to rotational movement, and allows the priming device to be more compact.

The location of the linear strip along the track also provides an indication of the proportion of receptacles that have not yet been loaded or unloaded. Such an indication is not provided by a symmetric primer holder disk.

The linear primer holder strip represents a significant departure from previous devices for holding primers. Given the unique structure of the strip, there are few instruments available to load the primers into the strip. Several embodiments of a new device for loading the primers into strips are described in connection with the drawings.

Figure 3:
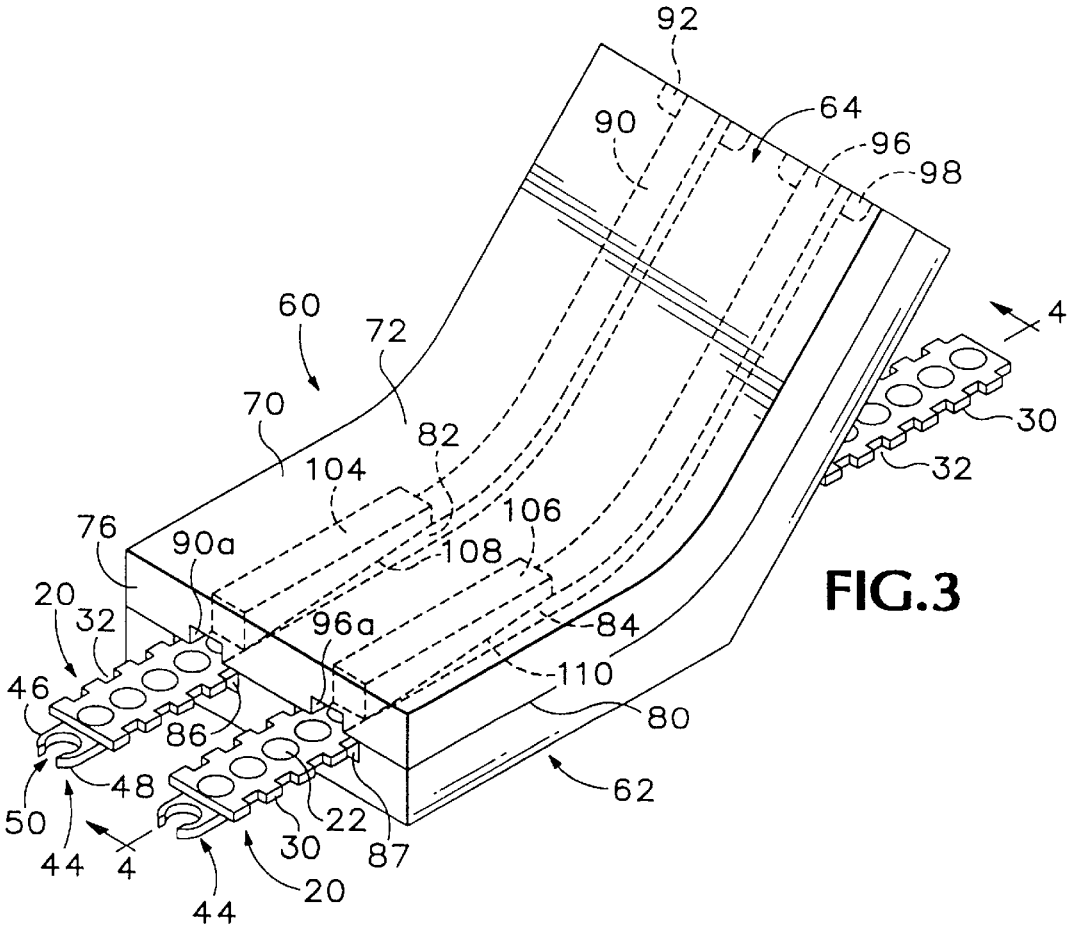
FIG. 3 is a top perspective view of a first embodiment of the loading device of the present invention, showing primer strips extending into and through two tracks in the device.
Figure 4:
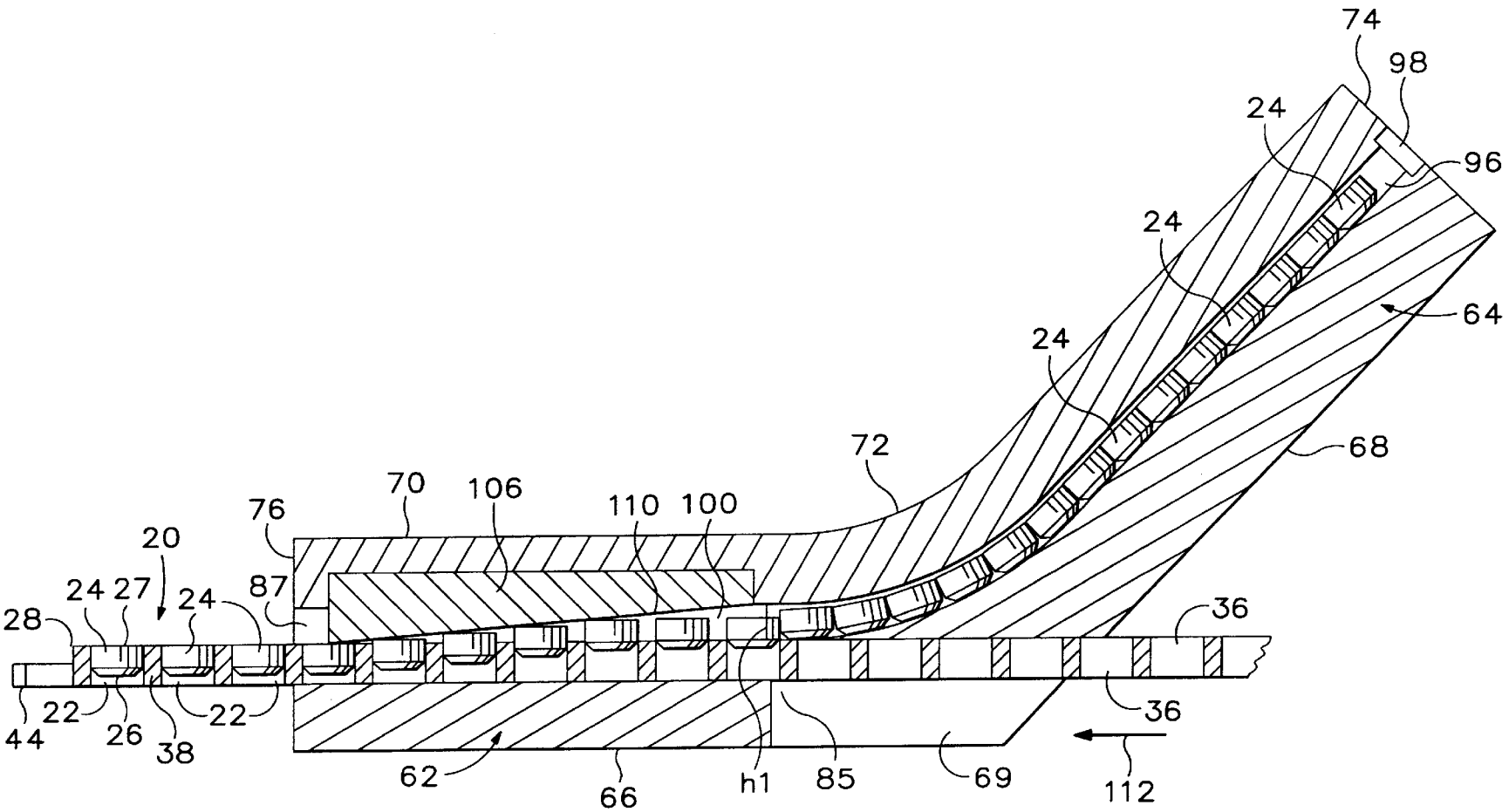
FIG. 4 is an enlarged, cross-sectional view taken along line 4—4 in FIG. 3.

Embodiment of FIGS. 3–4

A device 60 for loading primers 24 into a strip 20 is shown in FIGS. 3 and 4. The device includes an elongated rectilinear base 62 and an elongated, fixed rectilinear ramp 64 extending longitudinally from base 62 and inclined at an angle of about forty-five degrees to base 62. The base and ramp are preferably made of a clear, thermoplastic material, and each has a flat bottom surface 66, 68 (FIG. 4) which meet at an angle 69 of about 45°. A top surface 70 of device 60 is a continuous surface that extends the length of the device, and has an arcuate central section 72 that interconnects base 62 with ramp 64.

The side faces of device 60 are all flat, and include a flat entrance face 74 and a flat exit face 76. The embodiment of the device shown in the drawings is bipartite, and includes a top segment and a lower segment that are joined at a junction 80 (FIG. 3). The top and lower segments can be joined to one another with screws, adhesive, or other means. A one-piece molded construction of device 52 would also be suitable.

The base 62 is an elongated track member that defines a pair of elongated, parallel tracks 82, 84 extending through device 60. The tracks 82, 84 may be of different dimensions to accommodate strips 20 of different dimensions. The track 84, for example, may be narrower and/or shorter top to bottom, than the track 82. Each disclosed track 82, 84 is rectangular in cross-section and extends in a straight horizontal path from a cut-away track entry recess 85 provided in base 62 and ramp 64, to a track exit 86 or 87.

The shape of each track 82, 84 is generally rectangular in cross section and substantially the same width as the strip 20 such that strip 20 can slide (with minimum clearance between teeth 30 and the walls of the track) through the track 82. Flat outer faces of teeth 30 slide against flat side faces of track 82 to guide strip 20 in a straight path through the device. The clearance between teeth 30 of strip 20 and the side walls of track 82 is preferably tight (e.g., less than 0.5 mm), and is less than a diameter of the primer 24 to prevent primers from falling off the strip and becoming lodged between the strip and side wall of the track. The height of track 82 or 84 is substantially the same as the height of strip 20, including planar portion 28 and tubular extension 38.

A rectilinear delivery slot 90 extends through ramp 64 and into base 62 where it merges into the top of track 82. Slot 90 has a height and width substantially the same as a height and width of the primer that is to be loaded into the strip 20. An enlarged feed chamber 92, having a rectangular cross-section, opens into entrance face 74 of ramp 64, and has a depth about as great as the diameter of one of the primers 24. Delivery slot 90 extends from feed chamber 92 downwardly through ramp 64 in a vertical plane through which track 82 also extends. Delivery slot 92 then merges with the top of track 82, and extends along the midline of the top of track 82 to track exit 86, such that the top of track 82 has a central elevation that extends over the receptacles 22 when strip 20 is moving through track 82. FIG. 3 shows the opening **90*a* of the delivery slot 90 where it exits from face 76 of base 62**.

A separate rectilinear delivery slot 96 extends in a similar manner through device 60, parallel to delivery slot 90, from an enlarged rectangular receptacle 98 to an opening **96*a* in exit face 76. As shown in FIG. 4, slot 96 merges with the top of track 84 and forms an elongated rectangular recess 100 along the top of the track 84. Both of delivery slots 90 and 96 merge with their respective tracks 82, 84 downstream from the entrance of strip 20 into the tracks 82, 84. In this manner, primers 24 delivered through delivery slots 90, 96 fall under the influence of gravity through the delivery slots on to a strip 20 moving in a downstream direction from recess 85 toward track exit 86 or 87. The rectangular recess 100 at least initially provides a clearance for the primer to ride on top of strip 20** as it begins its progression in the downstream direction toward the track exit.

A pressure application member is provided above each track to push primers into receptacles 22 of strip 20. In the disclosed embodiment of FIGS. 3 and 4, the pressure application members, are a block 104 in track 90 and a block 106 in track 96. Blocks 104, 106 respectively have an inclined lower surface 108, 110 that inclines toward the track, in the downstream direction, over substantially the entire length of the track, for example sloping over about five of the receptacles 22 in strip 20. The angle of incline of surfaces 108, 110 in the disclosed embodiment is about 5°–15° (e.g. 10°) with respect to the linear path of strip through the track. The incline extends over a distance of about 35 mm. As illustrated in FIG. 4, inclined surface 110 inclines from an initial height h1 above strip 20 that is about the same as a height of primer 24, to a position that abuts against planar portion 28 of strip 20, and is flush with the tops of receptacles 22.

The operation of device 60 will be described in connection with slot 96 and track 84 as shown in FIG. 4, although it should be understood that primers can similarly be loaded into a strip 20 moving through track 82. A leading edge of strip 20 is introduced into the track 84 by positioning hook 44 (the leading edge of the strip) at the entrance 85 and pushing strip 20 in the downstream direction 112 along track 84 toward exit 86. After the first receptacle 22 of strip 20 enters track 84, primers 24 are introduced into slot 96. As shown in FIG. 4, multiple primers 24 can be introduced into slot 96, where they accumulate for loading into receptacles 22.

As strip 20 is manually pushed in downstream direction 112, primers 24 are carried along with the strip in the direction 112. As each primer encounters the sloping surface 110, it is progressively forced into a receptacle. The tapered edges of primer bottom 26 form inclined surfaces which ease the introduction of primers 24 into receptacles 22. When each primer reaches the downstream end of block 106, the inclined surface and the flat upper surface 27 of the primer is flush with the surface of the planar portion 28 of strip 20.

The device may be made of appropriate dimensions to be hand held. The base 62 and ramp 64, for example, may both be 6 cm long and 5 cm wide, with a height of 18 mm. With these dimensions, the device may be held in a human hand so that the strip 20 can be manually introduced into and pushed through the track. Primers 24 can similarly be manually fed into the delivery slot.

Embodiment of FIGS. 5–9

Figure 5:
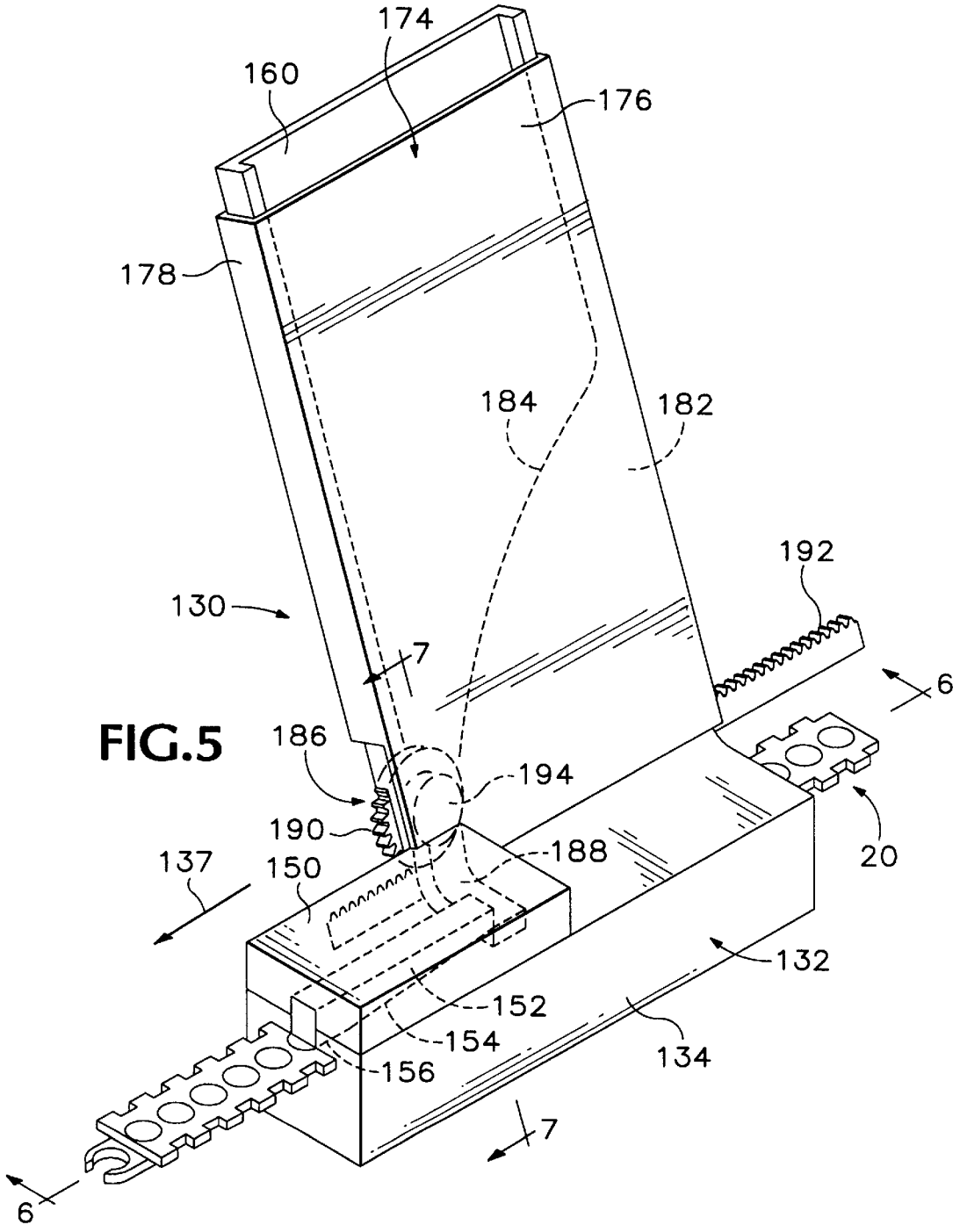
FIG. 5 is a top perspective view of a second embodiment of the loading device, showing a primer strip extending into and through the track.
Figure 6:
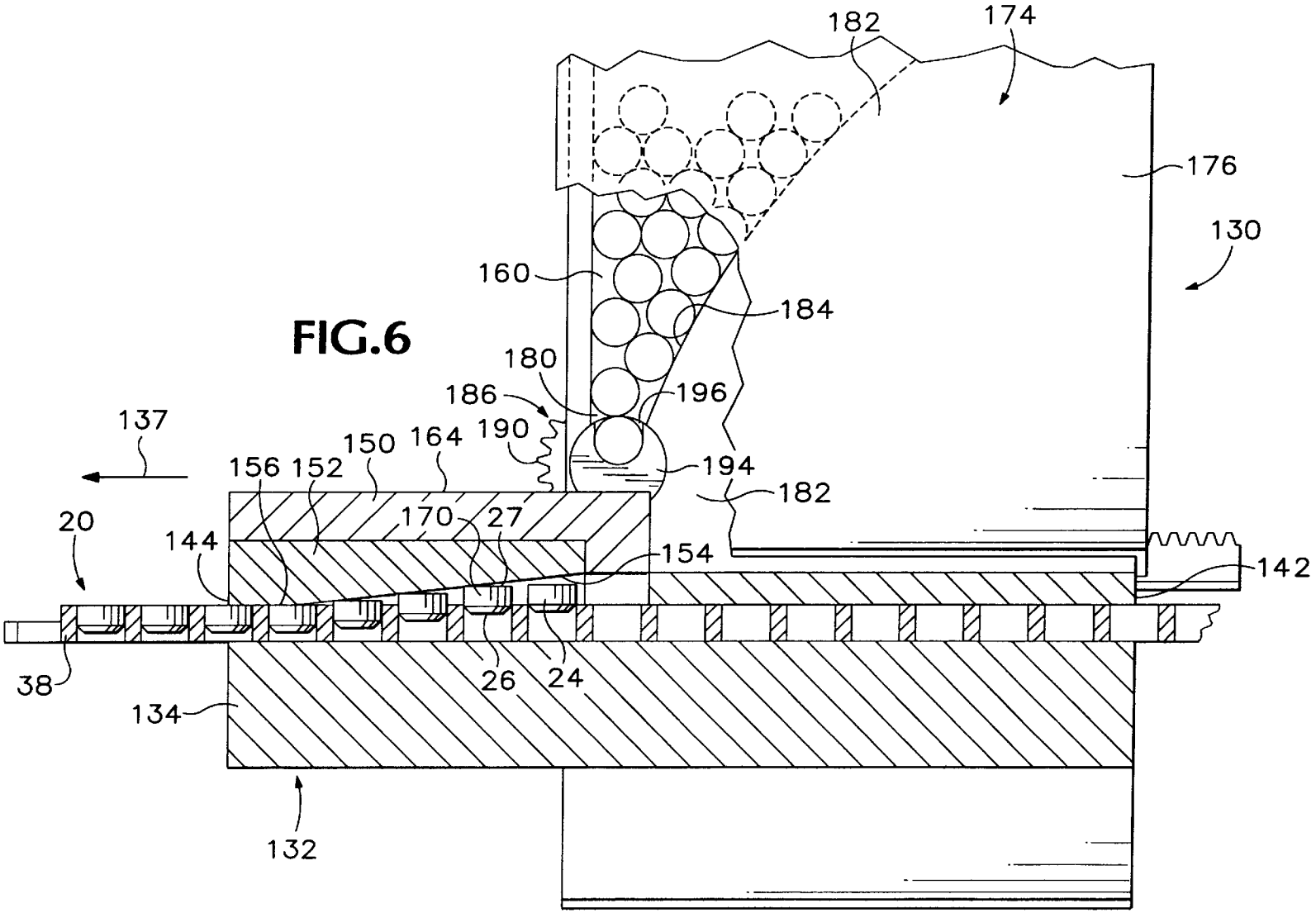
FIG. 6 is an enlarged cross-sectional view taken along line 6—6 in FIG. 5.

A second embodiment of the loading device is shown in FIGS. 5–9. The device 130 includes an elongated track member 132 comprising a clear plastic rectangular block base 134 that forms an elongated track 136 (FIG. 7) having a shape that is at least in part complementary to strip 20, and through which strip 20 slides in a downstream direction 137 (FIGS. 5 and 6). Track 136 has a base portion 138 (FIG. 7) that is substantially the same depth as tubular extensions 38, and is at least as wide or wider than the tubular extensions 38. An upper portion 140 of track 136 is wider than base portion 138 to accommodate teeth 30, which slide on a ledge formed by upper portion 140. The width of upper track portion 140 is preferably substantially the same as the width of the strip 20 (including teeth 30) such that the ledge provides a support platform that precisely guides strip 20 through track 136 in a straight downstream direction 137 from a track inlet 142 (FIG. 6) to a track outlet 144.

Figure 7:
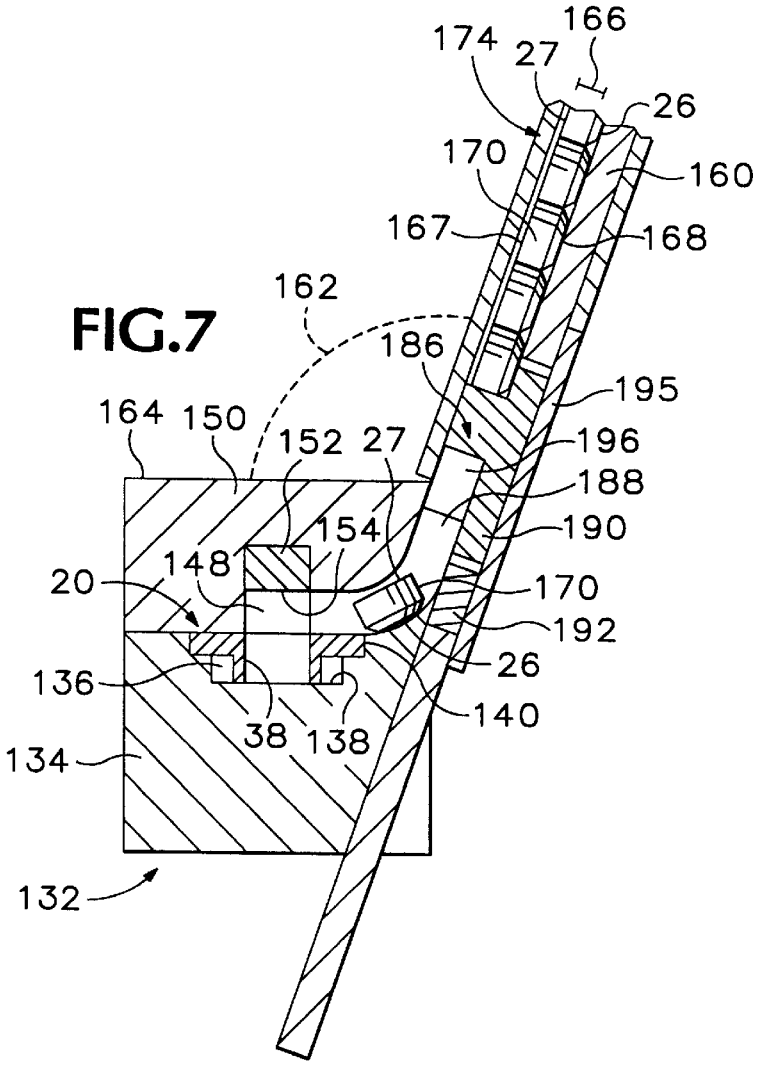
FIG. 7 is an enlarged cross-sectional view taken along line 7—7 in FIG. 5.

The upstream end of track 136 is enclosed within base 134, but the downstream end of the track has an open top that communicates with the top surface of base 134 through a rectilinear slot 148 (FIG. 7). A plastic cap 150 is seated on top of base 134 over slot 148 to enclose track 136, and form a primer loading station above the track within device 130 for inserting loose primers into receptacles 22 of the strip 20. An inner face of cap 150 has a corresponding slot in it that seats over slot 148, and contains a pressure application member 152. The member 152 is a rectangular block having a bottom inclined pressure application surface 154.

Surface 154 inclines at an angle of 5°–10° toward track 136 in the downstream direction 137, over a distance of about 35 mm. When the strip 20 is of the dimensions shown in FIG. 6, surface 154 inclines over about five receptacles 22. At the upstream end of member 152, the surface 154 is spaced away from the surface of strip 20 to allow a primer 24 to sit on top of strip 20 without fitting down in a receptacle 22. Surface 154 inclines gradually downwardly until the surface forms a portion 156 that is level with the planar portion 28 of strip 20, and is flat against the open top of receptacles 22. Pressure application member 152 therefore lowers the effective height of track 136 to substantially the same height as the strip 22 in track 136.

Primers are delivered into track 136 by a hopper tray 160 that has a lower end portion that extends longitudinally along track member 132, and remainder portions that extend transverse to track member 132 and track 136, at an angle 162 (FIG. 7) of about 120° to a top surface 164 of member 132. Tray 160 is a clear plastic tray having a height or internal clearance 166 (FIG. 7), between its base and cover, that is substantially the same as the height of a primer 24. These dimensions of the tray 160 align the primers flat in the tray, so that the primers slide on a flat primer face (such as surface 26 or surface 27) and do not allow the primers to roll against the tray on their cylindrical side surfaces 170. In the embodiment shown in FIG. 7, the primers are all loaded into tray 160 with the bottom surfaces 26 of the primers sliding on the tray 160. To achieve this goal, the internal clearance 166 of the tray is at least as great as the height of the primer 24, but less than the diameter of the primer.

A plastic tray cover 174 slides on tray 160 from the closed position shown in FIGS. 5–7, to a retracted open position in which the top face of the tray is open. Cover 174 includes a flat covering portion 176, and a pair of opposing, parallel, mirror image track members 178 (only one is shown in FIG. 5) that have inwardly turned lips which fit in back of tray 160 to allow cover 174 to slide on the tray toward and away from track member 132. Tray cover 174 is moved to the open position to load primers into tray 160, and is then closed during operation of device 130 when the primers are being delivered into track member 132 for insertion into strip 20.

Figure 8:
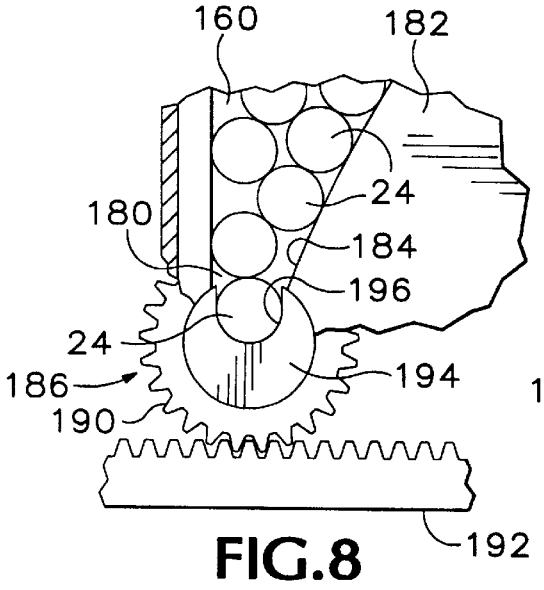
FIG. 8 is an enlarged, isolated view of the sprocket wheel mechanism for delivering a primer into the delivery slot of the device of FIG. 5, the track portion of the device not being shown to provide an unobstructed view of the sprocket wheel in the loading position.
Figure 9:
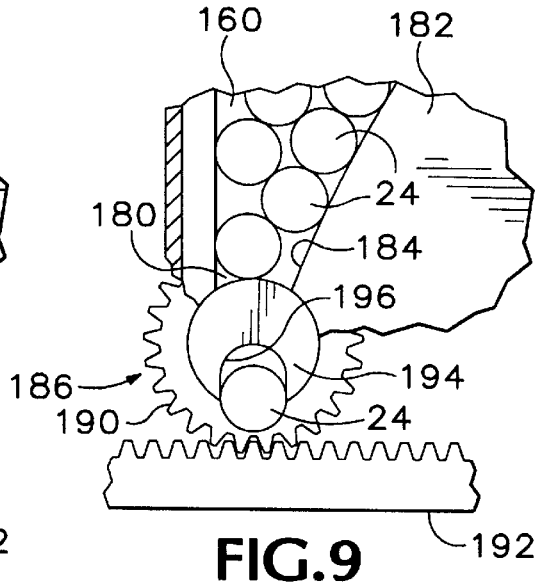
FIG. 9 is a view similar to FIG. 8, but with the sprocket wheel rotated to a delivery position.

Tray 160 and its cover 174 cooperatively define a primer hopper that directs the primers in the tray toward an outlet 180 (FIGS. 6 and 8–9). A raised barrier portion 182 of the tray 160 substantially fills the lower end of the tray to direct primers in the tray toward outlet 180. Barrier 182 forms a smooth, arcuate guide wall 184 that gradually narrows the hopper from a width of about 6 cm at the top edge of the tray 160 to a width of about 8–10 mm at outlet 180. The width of outlet 180 is only slightly greater than the width of each primer 24, and less than double the width of the primer. Given these dimensions of the outlet, primers within the tray can be funneled toward outlet 180 to be fed one at a time to a sprocket wheel 186 (FIGS. 5–6 and 8–9) positioned at the entrance to a delivery slot 188 (FIGS. 5 and 7) that communicates between tray 160 and track 136. Delivery slot 188 extends in a downward arcuate path in a vertical plane from outlet 180 to slot 148 (FIG. 7) above track 136. Delivery slot 188 enters transverse to slot 148, and opens into slot 148 in the area of the track where surface 154 is sufficiently high to permit primer 24 to fit on top of strip 20 in track 136.

Sprocket wheel 186 has a toothed peripheral portion 190 that lies in the plane of tray 160, and is positioned to interact with a ratchet bar or rack gear 192 positioned within a groove that extends longitudinally along a rear surface of track member 132, parallel to track 136. A raised central portion of sprocket wheel 186 forms a delivery member 194 that extends from the surface of tray 160 to cover 174, and occludes outlet 180. Delivery member 194 contains a tapering pocket or arcuate receptacle 196 that has a shape complementary to the rounded shape of a primer 24. Sprocket wheel 186 is supported by a plate 195 (FIG. 7) behind tray 160 so that the wheel can rotate, in the plane of the tray enclosure, from a loading position (FIG. 8) to a delivery position (FIG. 9). In the loading position, pocket 196 faces the outlet of inclined tray 160 so that a primer 24 can fall into pocket 196 under the influence of gravity. In the unloading position, pocket 196 faces down into delivery slot 188 so that primer 24 can fall out of pocket 196, under the influence of gravity, into delivery slot 188 and thence into track 136.

In operation, with sprocket wheel 186 occluding outlet 180, hopper tray 160 is loaded with primers 24 by sliding tray cover 174 upwardly away from base 132 to expose the interior of the tray. The tray is then loaded with primers by placing them in the orientation shown in FIG. 7, wherein the primers 24 slide with their flat surfaces 26 against the inner surface of tray 160. Cover 174 is then advanced to the closed position shown in FIGS. 5–7, and strip 20 is introduced into track 136 through track inlet 142, and pushed in the downstream direction 137 toward pressure application member 152.

When the leading edge of strip 20 reaches the pressure application member, ratchet bar 192 is reciprocated to move sprocket wheel 186 to the loading position shown in FIG. 8, with pocket 196 facing into the tray enclosure. A single primer 24 then falls into pocket 196, and ratchet bar 192 is moved to rotate sprocket wheel 186 to the unloading position shown in FIGS. 7 and 9, so that primer 24 falls out of pocket 196 and into delivery slot 188. The delivery slot 188 delivers primer 24 into track slot 148, on top of strip 20. As primer strip 20 is advanced through track 136, primer 24 is dragged along until it encounters surface 154 of pressure application member 152, which forces primer 24 backwardly until the primer is aligned over a receptacle 22 of the strip, and then downwardly into the receptacle.

Subsequent primers 24 are similarly delivered into track 136 by reciprocation of sprocket wheel 186, to continue to deliver primers 24 into track 136 for insertion into strip 20 by pressure application member 152. By coordinating advancement of strip 20 through track 136 with delivery of primers 24 by sprocket wheel 186, each receptacle 22 in strip 20 can be filled with a primer 24 as strip 20 moves in the downstream direction 137 through device 130.

Embodiment of FIGS. 10–13

Figures 10, 11:
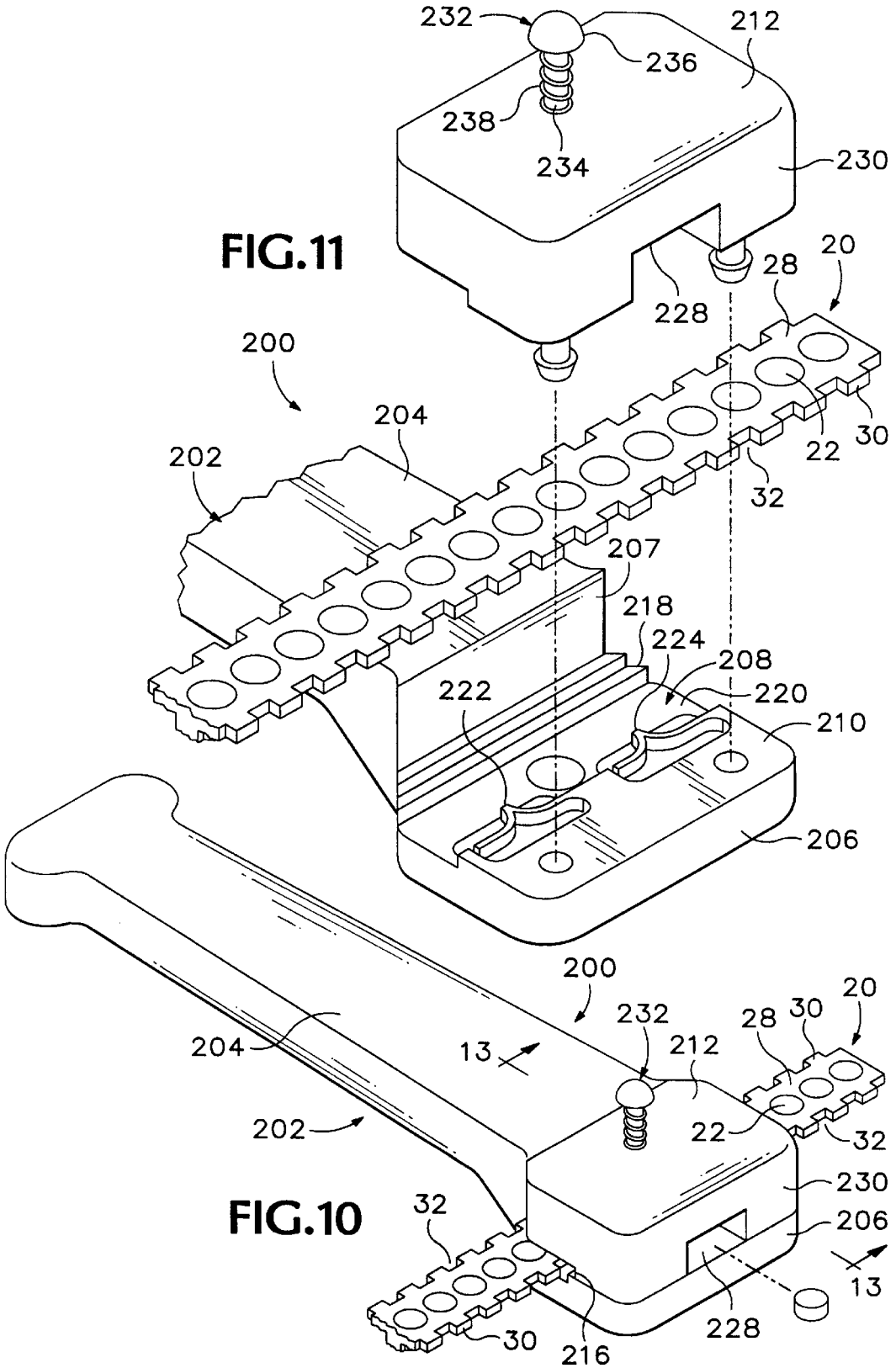
FIG. 10 is a top perspective view of a third embodiment of the device, in which a push pin inserts a primer into a target receptacle when the receptacle is aligned in a loading position beneath the push pin.
FIG. 11 is an enlarged, exploded, fragmentary view of the device shown in FIG. 10.
Figure 12:
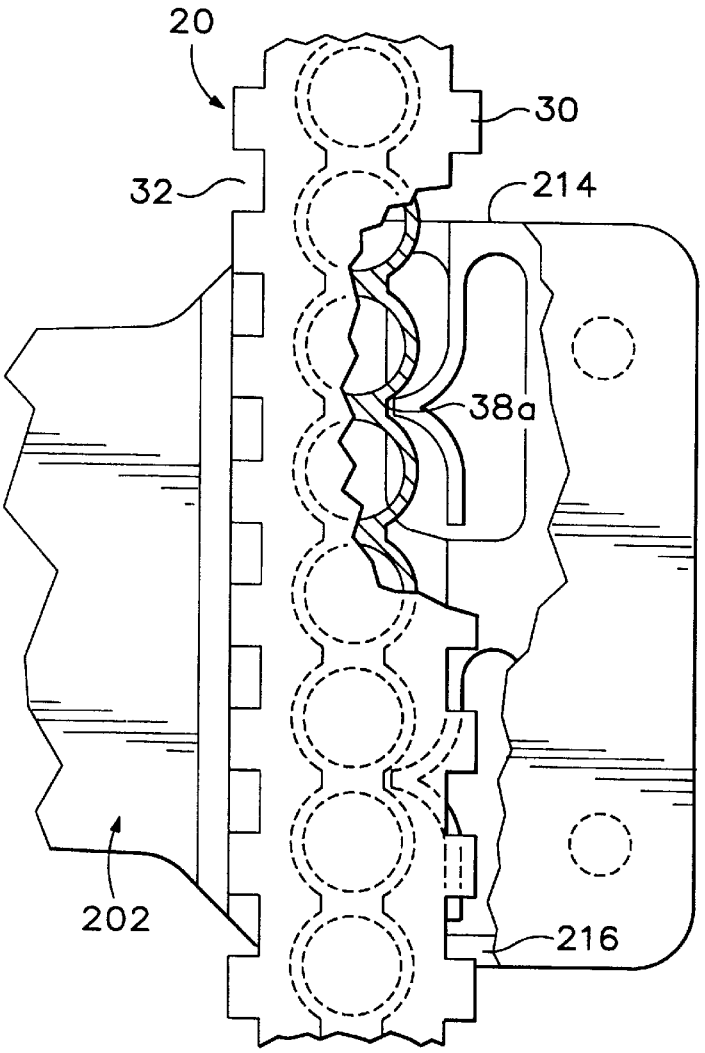
FIG. 12 is a top view of the base of a portion of the device shown in FIG. 10.

Another embodiment of the loading device is shown in FIGS. 10–13, which discloses a hand held device 200 (FIG. 10) that includes a base 202 having an elongated hand grip 204 and a flat head 206. As shown in FIG. 11, head 206 extends from a bottom edge of hand grip 204. A track 208 extends transverse to hand grip 204 (FIGS. 11 and 13), and includes a bottom portion that is recessed into a top surface 210 of head 206. A cap 212 (FIGS. 10 and 13) covers the surface 210 to form, in cooperation with surface 210, the elongated track 208 that extends through device 200 from a track inlet 214 (FIG. 12) to a track outlet 216 (FIGS. 10 and 12). Track 208 has a shape that is at least in part complementary to the shape of strip 20, with an enlarged ledge 218 (FIGS. 11 and 13) that is substantially as wide as the toothed portion of strip 20, and on which teeth 30 can slide in tight clearance with the upright walls of the ledge. Track 208 also includes a base clearance portion 220 that is narrower than the ledge portion, and in which tubular extensions 38 can slide as strip 20 moves in a straight path along track 208.

A pair of brace shaped tabs with indexing projections 222, 224 are provided in head 206 and extend into track 208 for interacting with depressions 38*a* of strip 20 as the strip moves through device 200. The spacing between the tips of projections 222, 224 are such that these tips fit in depressions 38*a* on either side of a target receptacle when the target receptacle is in a loading position, as discussed further below. The brace shaped tabs are molded integral with the head 206, and are sufficiently flexible to bend and allow strip 20 to be moved in the downstream direction when the strip is advanced through track 208. One end of each tab, such as the downstream end as shown in FIG. 11, may be unconnected to remainder portions of the device to provide desired flexibility and resilience for the tabs to operate as needed.

Base 202 and cap 212 cooperatively form a housing that defines a primer loading station where primers are inserted into receptacles 22 in strip 20. A delivery slot 228 extends from a front face 230 of cap 212 transversely into track 208, where the delivery slot communicates with a target position below a reciprocable pin 232 that extends through cap 212 at the intersection of delivery slot 228 and track 208. Pin 232 includes a shank 234 (FIGS. 11 and 13), an enlarged head 236, and a helical spring 238 coiled around shank 234 to bias pin 232 into the retracted position shown in FIG. 13. The diameter of shank 234 is substantially the same or less than the diameter of each receptacle 22, and the length of shank 234 is sufficient that its pressure application surface 240 (FIG. 13) reaches at least to the plane of planar portion 28 of strip 20.

Figure 13:
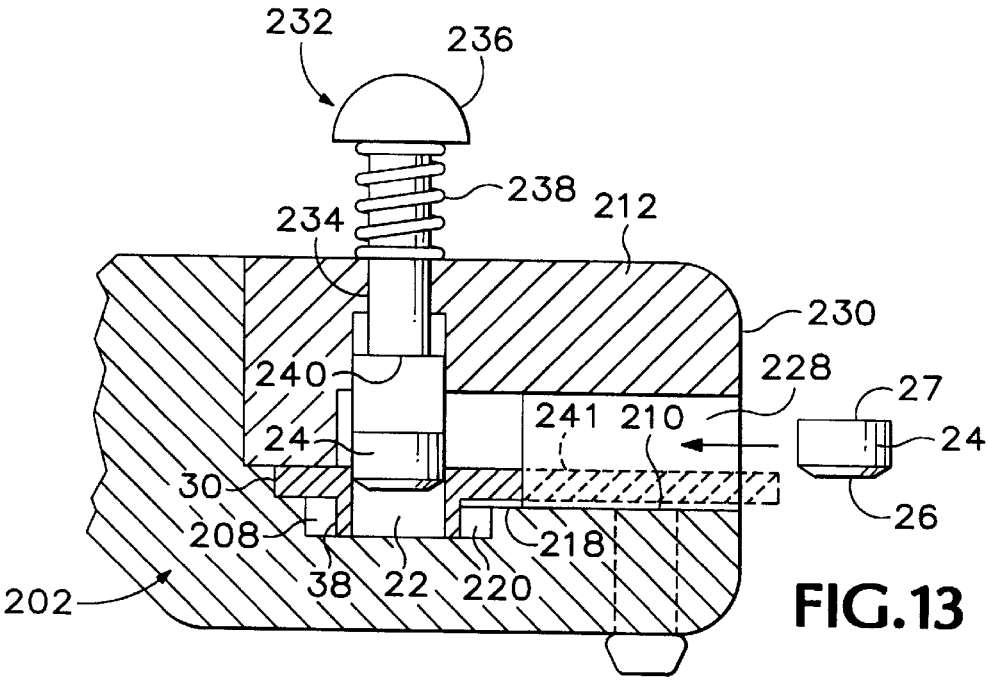
FIG. 13 is a cross-sectional view taken along lines 13—13 in FIG. 10.

In operation, the leading edge of strip 20 is introduced through track inlet 214 until a first receptacle 22 is aligned in the target position below shank 234. As shown in FIG. 13, a primer 24 is then fed into delivery slot 228 with the tapered flat surface 26 of the primer facing down. The primer may be fed into slot 228 using a small ramp 241, as illustrated in FIG. 13. The ramp may be of the kind shown and described in U.S. Pat. No. 5,435,223 which is incorporated by reference. Device 200 may then be tipped to advance primer 24 through delivery slot 228 to a loading position over the target receptacle 22. Push pin 232 is then moved against the bias of spring 238 (for example by pushing enlarged head 236 with a thumb while holding hand grip 204) to move the pin to an advanced position (not shown). Advancement of the pin 232 brings surface 240 of the pin into engagement with flat surface 27 of the primer in the loading position, and pushes primer 24 into the target receptacle over which the pin is positioned.

After pin 232 is retracted by removing pressure from the pin, strip 20 may then be advanced to position the next adjacent receptacle in the target position below push pin 232. Even if the receptacle 22 can not be directly visualized, a tactile indication of its appropriate positioning in the target position can be detected by the locking of the indexing tips 222, 224 in depressions 38*a* between tubular receptacles 38. As the strip 20 is subsequently advanced, indexing tips 222, 224 flex to allow strip 20 to move in the downstream direction. However the indexing tips spring back into a new pair of longitudinally spaced depressions 38*a* when the strip has sufficiently advanced to bring the next receptacle 22 into the target position.

Once a subsequent receptacle 22 is in the target position, another primer 24 is introduced through delivery slot 228 into the loading position, and push pin 232 is then again pushed (for example by the thumb of an operator) to load the primer into the target receptacle. This process is repeated until a desired number of the receptacles (preferably all the receptacles) of the strip are filled with primers.

Figure 14:
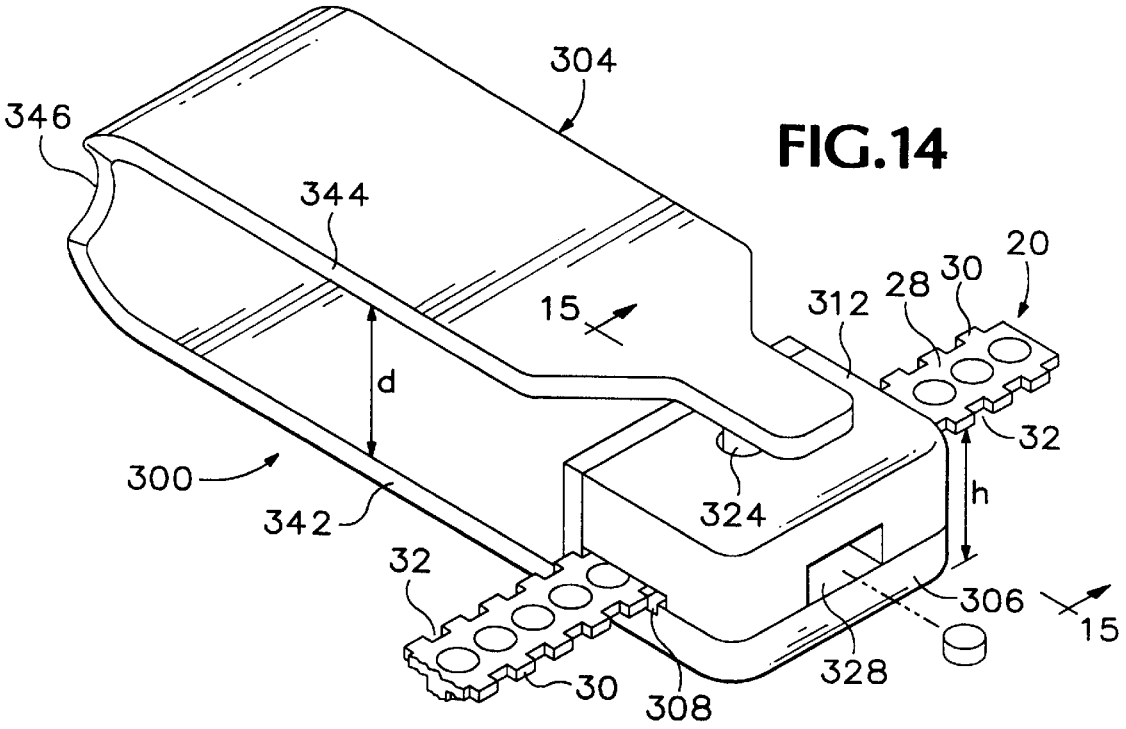
FIG. 14 is a top perspective view of a fourth embodiment of the device.
Figure 15:
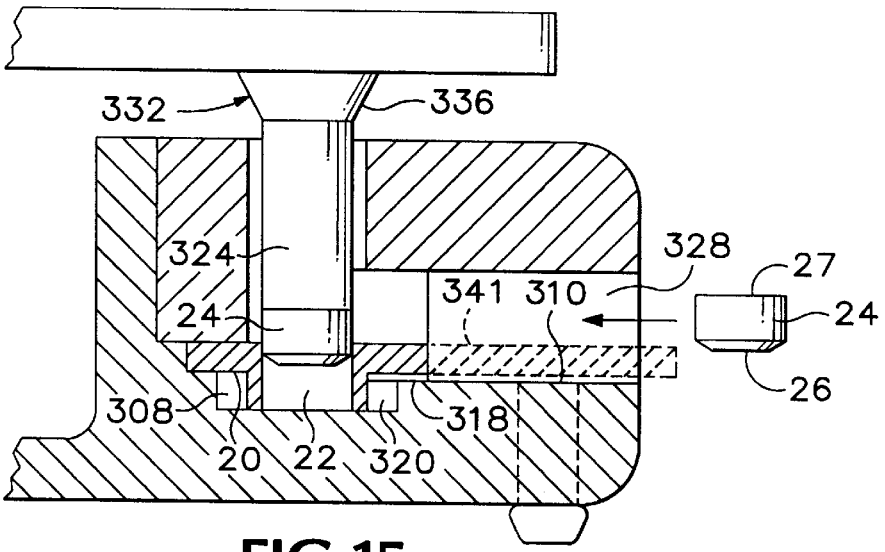
FIG. 15 is a fragmentary, cross-sectional view taken along line 15—15 in FIG. 14.

Embodiment of FIGS. 14–15

Yet another embodiment of the loading device is shown in FIGS. 14–15. This embodiment is similar to the embodiment of FIGS. 10–13, hence like parts have been given like reference numerals to those of FIGS. 10–13, plus 100. FIGS. 14–15 show a loading device 300 in which a head 306 is covered by a cap 312, and the head and cap cooperatively define a delivery slot 328 through which primers can be introduced into track 308. Instead of a spring biased push pin, however, this embodiment includes a biased hand grip 304 that maintains the push pin 332 in a retracted position.

Hand grip 304 has a flat bottom portion 342 connected to and extending in the same plane as head 306, and a flat top portion 344 having an inner face to which the enlarged head 336 of pin 332 is secured. Top and bottom portions 342, 344 are held spaced apart by a curved member 346, which in its neutral position (FIG. 14) holds bottom and top handle portions 342, 344 parallel to one another and spaced a distance d which is greater than the height h of the priming station formed by head 306 and cap 312. The handle portions 342, 344 and 346 are made of a sufficiently flexible material that top portion 342 can be flexed toward bottom portion 344 to advance pin 332 to the position shown in FIG. 15, and to a fully advanced position in which primer 24 is pushed completely into receptacle 22.

The operation of the embodiment of FIGS. 14–15 is similar to that of FIGS. 10–13, wherein strip 20 is advanced along track 308 until a receptacle 22 is locked in the target position by interaction of indexing tabs with depressions 38*a* of strip 20. A primer 24 is introduced through delivery slot 328 to a loading position above the target receptacle. The hand grip 304 is then squeezed (for example between the thumb and forefinger of a human hand) to push pin 332 inwardly and force primer 24 into receptacle 22. Once the primer is loaded into the target receptacle, the squeezing pressure on hand grip 304 is relaxed, and the resilience of the material of which hand grip 304 is made retracts push pin 332 to a retracted position. The strip 20 may then be advanced until another target receptacle is aligned with the push pin, another primer 24 is loaded through slot 328, and the hand grip squeezed to load a subsequent primer 24. This procedure may be repeated until all the receptacles of the strip have been loaded with primers.

Having illustrated and described the principles of the invention in several preferred embodiments, it should be apparent to those skilled in the art that the invention can be modified in arrangement and detail without departing from such principles. We claim all modifications coming within the spirit and scope of the following claims.

We claim:

1. A device for loading primers into a primer holder strip having a plurality of primer receptacles extending longitudinally along the strip, the device comprising:

an elongated track extending through the device;

a primer delivery slot in the device that is positioned to deliver a primer into the track; and a pressure application member positioned to press the primer into a primer receptacle.

2. The device of claim 1, wherein the pressure application member comprises an upper surface of the track, which is inclined toward the track in a direction of movement of the strip through the track, and the track is of dimensions that the primer delivered into the track is pressed into one of the receptacles as the track moves in the direction of movement.

3. The device of claim 2, wherein the primer delivery slot extends downwardly into the track, so that primers are delivered by gravity through the slot into the track upstream of the pressure application member.

4. The device of claim 3, wherein the device comprises a track portion through which the track extends, and an inclined delivery portion from which the delivery slot delivers the primer into the track portion.

5. The device of claim 4, wherein the delivery slot has a height and a width that is substantially the same as a height and a width of the primer.

6. The device of claim 5, wherein the delivery portion comprises a hopper in which the primer can slide only on a flat top or bottom surface of the primer toward the delivery slot, and a rotatable feed member is positioned at an entrance to the delivery slot for receiving the primer and delivering it into the delivery slot as the feed member rotates.

7. The device of claim 6, wherein the hopper comprises an enclosure having a height substantially the same as the height of the primer, and a guide member that narrows the enclosure toward the outlet slot.

8. The device of claim 6, wherein the rotatable feed member comprises a sprocket wheel that interacts with a movable toothed member to move the sprocket wheel between a loading position in which the primer can fall into an opening in the sprocket wheel, and an unloading position in which the primer can fall out of the opening in the sprocket wheel into the delivery slot.

9. The device of claim 8, wherein the movable toothed member comprises an elongated rack gear that moves along the track portion of the device.

10. The device of claim 6, wherein the hopper is a tray having a front surface that slides to an open position for loading primers into the tray.

11. The device of claim 4, wherein the delivery portion comprises a ramp inclined to and merging with the track portion, and the delivery slot extends through the ramp.

12. The device of claim 11, wherein the delivery slot and track both extend in a common plane, and the delivery slot merges with the track at a position that delivers the primer into the track upstream of the pressure application member.

13. The device of claim 1, wherein the primer delivery slot communicates between an exterior opening of the device and a primer loading station within the device, and the pressure application member is a reciprocable member that carries a pin positioned to extend through the primer loading station towards the primer receptacle of the strip when the strip is positioned within the track with the primer receptacle in a target position with the primer receptacle aligned with the reciprocable member.

14. The device of claim 13, wherein the primer holder strip comprises a plurality of teeth extending laterally from longitudinal edges of the strip, and the device further comprises indexing projections biased to interact with depressions in the strip to align the receptacle in the loading position.

15. A device for loading primers into a primer holder strip, wherein the strip has a plurality of primer receptacles arranged longitudinally along the strip, and a plurality of teeth extending laterally from longitudinal edges of the strip, the device comprising:

an elongated track member defining an elongated track through the device, wherein the track has substantially a same width as the primer holder strip, such that the primer holder strip can slide through the track;

a track entry at an upstream end of the track, into which the strip is introduced to load primers into the primer receptacles, and a track exit at a downstream end of the track, through which the strip emerges after the primers are loaded into the receptacles;

a pressure application member extending over the track, downstream from the track entry, and inclined toward the track in a downstream direction, that lowers a height of the track to substantially a same height as the strip when the strip is in the track; and a delivery ramp inclined toward the track member and defining a delivery slot therethrough, wherein the delivery slot extends in a common plane with the track and has a height and width substantially the same as a height and width of each primer, and the delivery slot merges with the track between the track entry and the pressure application member.

16. A device for loading primers into a primer holder strip, wherein the strip has a plurality of primer receptacles arranged longitudinally along the strip, and a plurality of teeth extending laterally from longitudinal edges of the strip, the device comprising:

an elongated track member defining an elongated track through the device, wherein the track comprises a portion having a complementary shape and substantially a same width as the primer holder strip, such that the primer holder strip can slide through the track opening;

a track entry at an upstream end of the track, into which the strip is introduced for loading primers into the primer receptacles, and a track exit at a downstream end of the track, from which the strip emerges after the primers are loaded into the receptacles;

a pressure application member extending over the track, downstream from the track entry, and inclined toward the track in a downstream direction, wherein the pressure application member lowers a height of the track to substantially a same height as the strip when the strip is in the track;

a delivery member comprising a hopper tray extending along a longitudinal edge of the track member, wherein the hopper tray has a height substantially the same as a height of each primer, such that the primer can slide within the hopper tray only on a flat top or bottom surface of the primer;

a slidable cover on the hopper tray that slides between an open hopper loading position and a closed feeding position, wherein the hopper tray has an internal barrier that funnels the primer toward an outlet from the tray;

a delivery slot extending through a plane transverse to the track and in an arc from the outlet of the tray into the track, between the track entry and the pressure application member;

a sprocket wheel in the tray at the outlet, wherein the sprocket wheel defines a primer holder having a shape complementary to a shape of the primer, and the sprocket wheel is movable between a loading position in which the primer holder faces into the tray and the primer can be received from the tray into the primer holder in the sprocket wheel, and an unloading position in which the primer holder is directed toward the outlet, and the primer can fall out of the primer holder into the delivery slot; and an elongated rack gear extending through a rack guide slot extending parallel to the track in the track member, with teeth of the rack guide engaging teeth of the sprocket wheel to move the sprocket wheel as the elongated rack gear moves in the rack guide slot.

17. A device for loading primers into a primer holder strip, wherein the strip has a plurality of primer receptacles arranged longitudinally along the strip, and a plurality of teeth extending laterally from longitudinal edges of the strip, the device comprising:

an elongated track member defining an elongated track through the device, wherein the track comprises a portion having a complementary shape and substantially a same width as the primer holder strip, such that the primer holder strip can slide through the track;

a track entry at an upstream end of the track, into which the strip is introduced to load primers into the primer receptacles, and a track exit at a downstream end of the track, through which the strip emerges after the primers are loaded into the receptacles;

a housing defining a primer loading station within the device above the track, a delivery slot extending from a surface of the device into the primer loading station, and a reciprocable push pin extending through the housing toward the primer loading station, wherein the push pin is reciprocable between a retracted position and an extended position, and the push pin in the extended position extends into the primer loading station to push the primer in the primer loading station into a target receptacle, and the pin is biased to the retracted position; and a plurality of indexing projections adjacent the track that interact with the strip to hold the target receptacle in a target position aligned with the push pin.

18. A device for loading primers into a primer holder strip having a plurality of primer receptacles extending longitudinally along the strip, and teeth extending transversely from longitudinal edges of the strip, the device comprising:

track means through the device for guiding the strip through the device;

delivery means for introducing a primer into the track means; and pressure application means for pushing the primer into a target receptacle after the delivery means has introduced the primer into the track means.

19. The device of claim 18, wherein the delivery means comprises a slot means for delivering the primer by gravity into the track means upstream of the pressure application means.

20. The device of claim 19, wherein the delivery means is an inclined ramp through which the slot means extends.

21. The device of claim 19, wherein the delivery means further comprises a movable delivery member that moves between a receiving position in which the primer is loaded into the delivery member, and an unloading position in which the primer is delivered to the slot means.

22. The device of claim 19, wherein the pressure application means comprises an inclined surface of the track means.

23. The device of claim 19, wherein the pressure application means comprises a reciprocable push pin.

24. The device of claim 23, further comprising alignment means for positioning the strip with the target receptacle aligned with the push pin.

25. A method of loading primers into a primer holder strip having a plurality of primer receptacles extending longitudinally along the strip, and teeth extending transversely from longitudinal edges of the strip, the method comprising:

providing a loading device having an elongated track extending through the device, wherein the track allows the strip to slide through the device, a primer delivery slot in the device that is positioned to deliver a primer into the track, and a pressure application member positioned to press the primer into a primer receptacle;

introducing the strip into the track and advancing the strip toward the pressure application member; and providing the primer on the strip, and pushing the primer into a target receptacle with the pressure application member.

26. The method of claim 25, wherein the step of pushing the primer into a target receptacle comprises providing a pressure application member above the track that includes an inclined surface that is inclined toward the track in a direction of movement of the strip through the track, and advancing the strip toward the pressure application member to allow the inclined surface to progressively force the primer into the receptacle as the slot advances toward the pressure application member.

27. The method of claim 26, further comprising the step of feeding the primer into the track above the strip upstream of the pressure application member.

28. The method of claim 27, wherein the step of feeding the primer into the track comprises feeding the primer into the track through a downwardly extending, inclined delivery slot.

29. The method of claim 26, wherein the step of pushing the primer into the target receptacle comprises positioning the primer over a target receptacle, and advancing a push pin toward the target receptacle to push the primer into the target receptacle.

30. The method of claim 29, further comprising the step of aligning the target receptacle with the push pin by providing indexing projections that interact with the strip and hold the strip in a position in which the target receptacle is aligned with the push pin.

31. The method of claim 28, further comprising the step of providing a hopper for holding a primer in a fixed orientation and feeding the primer to a receptacle on a movable wheel, then moving the wheel between a loading position in which the primer is loaded from the hopper into the receptacle, and a delivery position in which the primer is dropped into the delivery slot.

32. The method of claim 31, further comprising the step of providing an elongated rack gear that slides along the track, and has teeth that interact with and turn the sprocket wheel, and moving the rack gear to reciprocate the sprocket wheel between the loading position and the delivery position.

* * * * *